US005263273A

United States Patent [19]

Lishness

[11] Patent Number: 5,263,273

[45] Date of Patent: Nov. 23, 1993

[54] FOLLOWER FOR A CARTRIDGE MAGAZINE

[75] Inventor: Bryant L. Lishness, Bristol, Conn.

[73] Assignee: Colt's Manufacturing Company Inc., West Hartford, Conn.

[21] Appl. No.: 782,429

[22] Filed: Oct. 25, 1991

[51] Int. Cl.[5] ..... F41A 9/70

[52] U.S. Cl. ..... 42/50

[58] Field of Search ..... 42/49.01, 49.02, 50, 42/7, 18, 22

[56] References Cited

U.S. PATENT DOCUMENTS

| | | | |
|---|---|---|---|
| 1,293,877 | 2/1919 | Nelson | 42/50 |
| 1,323,063 | 11/1919 | Johnson et al. | 42/50 |
| 1,407,633 | 2/1922 | Burton | 42/50 |
| 2,944,357 | 7/1960 | Smith et al. | 42/50 |
| 4,109,401 | 8/1978 | Musgrave | 42/50 |
| 4,296,729 | 9/1942 | Mossberg | 42/50 |
| 4,502,237 | 3/1985 | Krogh | 42/50 |
| 4,514,922 | 5/1985 | Farrar et al. | 42/50 |
| 4,586,281 | 5/1986 | Chesnut | 42/50 |
| 4,805,333 | 2/1989 | Doria et al. | 42/50 |

OTHER PUBLICATIONS

"The Gun Digest Book of Exploded Firearms Drawings, 3rd Edition" Edited by Harold A. Murtz, 1982, pp. 361–362.

*Primary Examiner*—Stephen C. Bentley
*Attorney, Agent, or Firm*—Perman & Green

[57] ABSTRACT

A cartridge magazine for use with a firearm includes a housing, a spring, and a follower. The follower is comprised of sheet metal that is cut and stamped to form a top section and two side sections. The top has a cartridge trough on its top side and a spring trough on its bottom side. The side sections and top section establish a spring receiving cavity.

12 Claims, 1 Drawing Sheet

FOLLOWER FOR A CARTRIDGE MAGAZINE

BACKGROUND OF THE INVENTION

1. Field of the Invention

The present invention relates to cartridge magazines for use with firearms and, more particularly, to an improved follower for use in a magazine and a method of manufacturing the same.

2. Prior Art

U.S. Pat. No. 4,514,922 to Farrar et al. discloses a follower in a cartridge magazine with an area for receiving an upper end of a spring. U.S. Pat. No. 1,407,633 to Burton also discloses a follower with an area for receiving an upper end of a spring. Followers have also been made of sheet metal, polymer material, and cast metal or machined metal in the past.

Various problems exist in the cartridge magazine area. One of these problems is the ability of a magazine to hold a larger number of cartridges without increasing the size of the magazine. Another problem is the manufacture of a follower from sheet metal without the need of welding or other processes to provide a follower that will not be inadvertently pushed out of the magazine housing.

It is an objective of the present invention to provide a new and improved cartridge magazine and method of manufacturing the magazine that solves these problems as well as provide additional features.

SUMMARY OF THE INVENTION

The foregoing problems are overcome and other advantages are provided by a follower for use in a firearm cartridge magazine that has a spring receiving cavity formed by a top and side walls of the follower and a method of manufacturing the same.

In accordance with one embodiment of the present invention, a follower for use in a firearm cartridge magazine is provided. The follower is comprised of a single frame member having a top section, a first side section, and a second side section. Each of the side sections extend down from the top section and have front and rear portions extending towards each other to establish a spring receiving cavity. The frame member has a substantially uniform thickness with the top section having a cartridge trough on a top surface thereof and a spring trough on a bottom surface thereof.

In accordance with another embodiment of the present invention, a cartridge magazine for use with a firearm is provided. The magazine comprises a housing, a spring, and a follower. The housing has a cartridge receiving cavity. The spring is located in the receiving cavity. The follower is located in the receiving cavity and is biased by the spring towards a top of the housing. The follower is comprised of a stamped sheet of metal having a top section and two side sections extending down from the top section to form a spring receiving cavity. At least one of the side sections has front and rear portions bent towards the opposite side section to prevent the follower from being inadvertently pushed out of the housing at the housing top.

In accordance with one method of the present invention, a method of manufacturing a follower for use in a firearm cartridge magazine is provided. The method comprises steps of cutting a blank from a flat sheet of metal; and stamping the blank to form a top section and at least one side section extending down from the top section. The step of stamping the blank includes forming a center cartridge trough along a top side of the top section and forming a peripheral spring trough along the bottom side of the top section.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
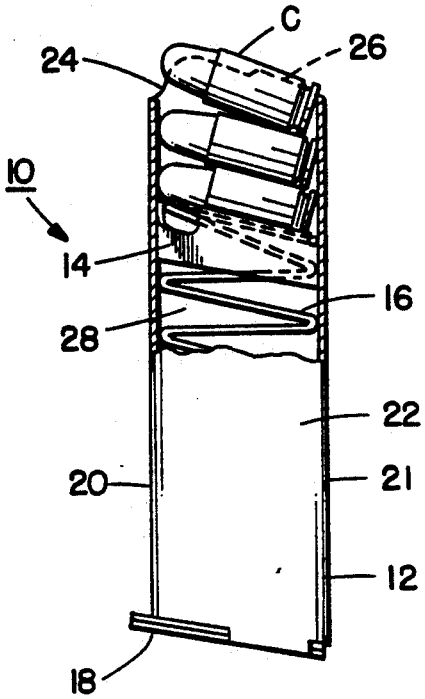
FIG. 1 is a side view of a cartridge magazine holding cartridges with a partial cut away section.

Referring to FIG. 1, there is shown a side view of a cartridge magazine 10 incorporating features of the present invention. Although the present invention will be described below with reference to the one embodiment shown in the drawings, it should be understood that the present invention may be incorporated into various different types of embodiments. In addition, any suitable size, shape, or type of elements or materials may be used to practice the invention as further understood from the description below.

The magazine 10 generally comprises a housing 12, a follower 14, and a spring 16. The housing 12 can be made of any suitable material, such as metal or plastic, and generally comprises a bottom 18, end walls 20 and 21, side walls 22 (only one of which is shown), a relatively open top 24 having retaining lips 26, and establishes an interior cavity 28. The spring 16 and follower 14 are located in the interior cavity 28. The spring 16 contacts the bottom 18 of the housing 12 and biases the follower 14 towards the top 24 of the interior cavity 28. However, the follower 14 is movable down the interior cavity by compression of the spring 16. The follower 14 is prevented from exiting the top 24 of the housing 12 by the presence of the lips 26 on both sides of the housing. The lips 26 also function to retain cartridges C with the magazine 10 at the top 24.

Figure 7:
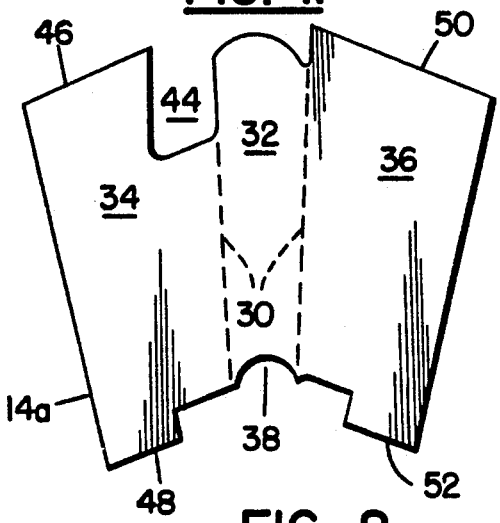
FIG. 7 is a plan top view of a follower blank used to form the follower shown in FIG. 2 prior to bending and shaping of the blank.
Figure 2:
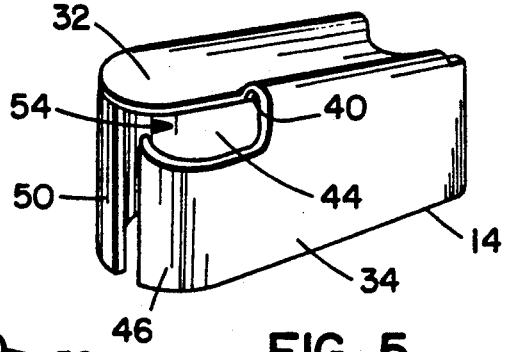
FIG. 2 is a front and side perspective view of the follower used in the magazine shown in FIG. 1.
Figure 3:
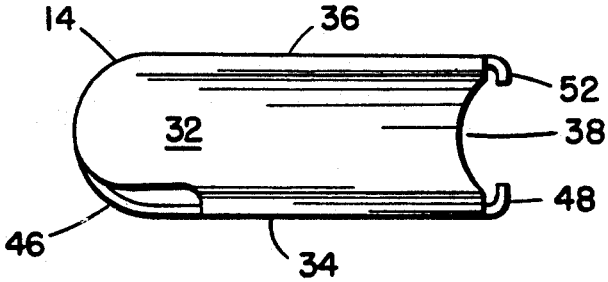
FIG. 3 is a plan top view of the follower shown in FIG. 2.
Figure 5:
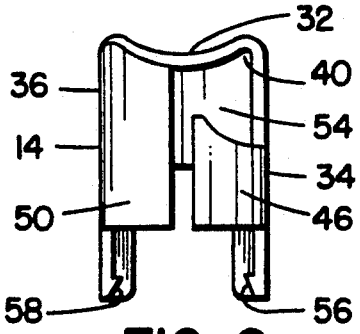
FIG. 5 is a plan front view of the follower shown in FIG. 2.
Figure 4:
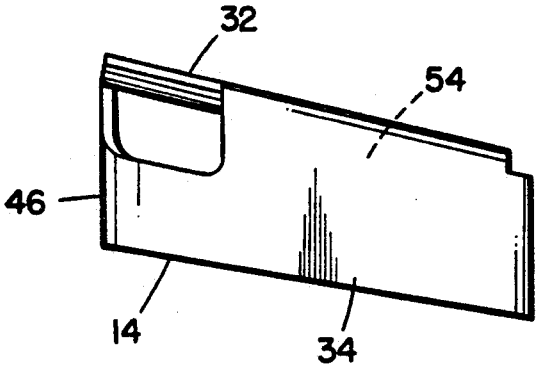
FIG. 4 is a plan side view of the follower shown in FIG. 2.
Figure 6:
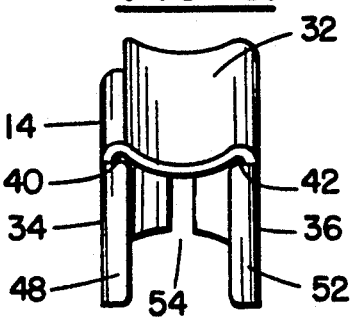
FIG. 6 is a plan rear view of the follower shown in FIG. 2.

Referring also to FIGS. 2–6, the follower 14 is shown. The follower 14, in the embodiment shown, is comprised of a sheet metal member that is cut to form the follower blank **14*a* shown in FIG. 7. However, the follower could also be made as a molded or formed plastic or polymer member. In the embodiment shown after the blank 14*a* is cut from the sheet metal, it is deformed or bent, such as by use of progressive die stamping or coining, to form the final shape shown in FIGS. 2–6. Dashed lines 30 generally indicate areas that the blank 14*a* is bent between its intended top section 32 and side sections 34 and 36. The top section 32 is stamped to form a curved indentation along its length to act as a cartridge trough. In the embodiment shown, the cartridge trough varies in depth along the length of the follower 14 with its deepest location at the rear of the top section 32. However, the cartridge trough could also have a uniform thickness or, in another alternate embodiment, the cartridge trough need not be provided. The rear of the top section 32 has a cut away area 38. The junctions of the top section 32 with the side sections 34 and 36 form spring troughs 40 and 42 on the follower's bottom side. The spring troughs 40 and 42 provide a space for the upper portion of the spring 16 to be located therein. The cut away section 38 allows the top rear portion of the spring 16 to travel from one spring trough to the other along the rear of the follower 14 without interference from the curved nature of the top section 32. Thus, the top of the spring 16 can be kept in a snug seat in the spring troughs 40 and 42. In the embodiment shown, as best seen in FIG. 6, a portion of the cartridge trough extends below the spring troughs 40 and 42**.

The first side section 34 extends down from the top section 32 and includes a front cut away section 44, a front section 46, and a rear section 48. The second side section 36 also extends down from the top section 32 and includes a front section 50 and a rear section 52. The two front sections 46 and 50 are bent towards each other with a curvature similar to the front of the top section 32 which is similar to the interior of the magazine housing front end wall 20. The two rear sections 48 and 52 are also bent towards each other to form a profile similar to the shape of the interior of the magazine housing rear end wall 21.

The follower 14 thus establishes a substantially enclosed spring receiving cavity 54 for receiving the top section of the spring 16. This spring receiving cavity 54 is also adapted to have the spring 16 substantially entirely compressed thereinto when the follower 14 is moved down to the bottom of the interior cavity 28. In the embodiment shown, the side sections 34 and 36 also include beveled tapers 56 and 58 at their bottoms to assist in allowing portions of the spring 16 to move in and out of the receiving cavity 54 as the follower 14 is moved up and down in the interior cavity 28.

The present invention provides various features. First, because the follower 14 is made of plastic or a stamped sheet of metal, it is obviously less expensive to manufacture that a cast metal follower. Second, the follower 14 provides an effective space for the spring 16 to be compressed into. This allows more available space in the receiving cavity 28 above the follower 14, when the follower 14 is totally compressed, to receive cartridges. Third, the spring troughs 40 and 42 combined with the cartridge trough on the top side of the top section 32 to allow the top of the spring 16 to be located even with the bottom of the cartridge on the follower. A portion of the cartridge may also extend below a portion of the spring in the receiving cavity 28. This, thus, allows more available space above the follower for cartridges to be stored when the follower 14 is fully compressed into the housing 12. Fourth, the substantial amount of side surfaces and front surfaces of the follower 14 allows the follower to move more smoothly up and down the receiving cavity 28. In addition, when the follower 14 is located at the top 24 of the housing 12, in contact with the retaining lips 26, the depth of the sides 34 and 36 and resulting depth of the front sections 46 and 50 prevent the follower 14 from being inadvertently pushed out of the relatively open top 24.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A follower for use in a firearm cartridge magazine, the follower being comprised of a single frame member having a top section, a first side section, and a second side section, each of the side sections extending down from the top section and having front and rear portions extending towards each other to establish a spring receiving cavity, the frame member having a substantially uniform thickness with the top section having a cartridge trough on a top surface thereof and a spring trough on a bottom surface thereof.

2. A follower as in claim 1 wherein the frame member is sheet metal.

3. A follower as in claim 1 wherein a rear of the top section has a cut-away section.

4. A follower as in claim 1 wherein the top section has a spring trough on both sides of the top section at intersections with the side sections.

5. A follower as in claim 1 wherein the cartridge trough varies in depth along a length of the follower.

6. A follower as in claim 1 wherein at least a portion of the cartridge trough extends below the spring trough.

7. A cartridge magazine for use with a firearm, the magazine comprising:

a housing having a cartridge receiving cavity;

a spring located in the receiving cavity; and a follower located in the receiving cavity and biased by the spring towards a top of the housing, the follower having a top section and two side sections extending down from the top section to form a spring receiving cavity, at least one of the side sections having front and rear portions bent towards the opposite side section to prevent the follower from being inadvertently pushed out of the housing at the housing top.

8. A magazine as in claim 7 wherein the top section has a cartridge trough on its top side.

9. A magazine as in claim 7 wherein the top section has at least one spring trough on its bottom side.

10. A magazine as in claim 7 wherein a rear of the top section has a cut-away section.

11. A magazine as in claim 7 wherein the follower includes means for positioning a portion of a cartridge below a portion of the spring in the receiving cavity.

12. A magazine as in claim 7 wherein bottom edges of the side sections have an interior beveled shape.

* * * * *